US005201332A

United States Patent [19]

Wu

[11] Patent Number: 5,201,332

[45] Date of Patent: Apr. 13, 1993

[54] CAP-SHAPED UMBRELLA HELD TO THE HEAD

[76] Inventor: Tze-Bing Wu, 8, Wu Chuan 5th Str., Taichung City, Taiwan

[21] Appl. No.: 782,473

[22] Filed: Oct. 25, 1991

[51] Int. Cl.[5] ..... A45B 3/00

[52] U.S. Cl. ..... 135/16; 135/20.1; 135/25.31; 135/21

[58] Field of Search ..... 135/16, 21, 25.33, 27, 135/28, 31, 20.1, 25.3, 25.31

[56] References Cited

U.S. PATENT DOCUMENTS 2,227,554 1/1941 Riordon ..... 135/28 X
2,726,668 7/1952 Levine .
3,049,720 6/1960 Caine .
3,374,488 10/1965 Erbb .
3,643,674 2/1972 Granrath ..... 135/28 X
3,921,655 11/1975 Weber ..... 135/28 X
4,131,954 1/1979 Brock et al. .
4,326,301 4/1982 Brock .
4,641,675 2/1987 Wu .
4,760,610 8/1988 Wu et al. .

*Primary Examiner*—Richard E. Chilcot, Jr.
*Assistant Examiner*—Lan M. Mai
*Attorney, Agent, or Firm*—Bacon & Thomas

[57] ABSTRACT

A cap-shaped umbrella for carrying on the head, comprising a folding radial frame, an auxiliary folding frame pivoted to said folding radial frame, an umbrella cover stretched over said folding radial frame, a front visor connected to the peripheral edge of said umbrella cover and stretched over said auxiliary folding frame, a fastening loop assembly connected to said auxiliary folding frame for fastening the umbrella to the head, and a control mechanism controlled to stretch or collapse said folding radial frame and said auxiliary folding frame.

1 Claim, 3 Drawing Sheets

CAP-SHAPED UMBRELLA HELD TO THE HEAD

BACKGROUND OF THE INVENTION

The present invention relates to umbrellas and relates more particularly to a cap-shaped umbrella which comprises a cap-shaped shade stretched over a folding radial frame and an auxiliary folding frame and carried on the head for protection against the rain or sun.

Conventionally, an umbrella is generally comprised of a screen or shade, usually of cloth stretched over a folding radial frame which is supported on a handle and carried by the hand for protection against the rain or sun. However, it is inconvenient to carry things in one's hands while one is holding an umbrella for protection against the rain or sun. Further, the muscle of the hand may ache easily while holding an umbrella after a certain length of time. There are several head mounting umbrellas designed to eliminate these problems, exemplars of which are indicated in U.S. Pat. Nos. 3,374,488; 2,726,668; 3,049,720; 4,326,301; 4,131,954. However, these head mounting umbrellas are still not satisfactory in use. These structures of umbrellas are complicated and expensive to manufacture and may be fall from place when mounted on the head. Because the head band or head device for fastening an umbrella to the head is fastened to the folding radial frame of an umbrella at the center, it makes stretching inconvenient and simultaneously increase the total height of a head mounting umbrella. Since the umbrella cover is spaced far from an user's head when an umbrella is in use, less protection is provided to the user. Because the umbrella cover can only protect a narrow area around the head, one's paints or feet will be moistened by rain while walking. If to increase the total size of the umbrella cover, the folding radial frame shall be relatively increased. When an umbrella of extended size is mounted on one's head, the muscles of the head will ache easily and, one's sightline may be obstructed.

SUMMARY OF THE INVENTION

The present invention has been accomplished to eliminate the aforesaid problems and disadvantages. It is therefore an object of the present invention to provide a cap-shaped umbrella for carrying on the head which is easy to operate and can be controlled to stretch an umbrella cover and a front visor simultaneously. It is another object of the present invention to provide a cap-shaped umbrella for carrying on the head which is practical and durable in use and can be firmly comfortably fastened on the head. It is still another object of the present invention to provide a cap-shaped umbrella for carrying on the head which gives wide protection and does not obstruct the sightline.

According to the present invention, there is provided a cap-shaped umbrella for carrying on the head, which is generally comprised of a folding radial frame, an auxiliary folding frame pivoted to said folding radial frame, an umbrella cover stretched over said folding radial frame, a front visor connected to the peripheral edge of said umbrella cover and stretched over said auxiliary folding frame, a fastening loop assembly connected to said auxiliary folding frame for carrying on the head, and a control mechanism controlled to stretch or collapse said folding radial frame and said auxiliary folding frame. The fastening loop assembly has two fastening bands connected to each other over an user's lower jaw by fastening means. In the preferred embodiment of the present invention, velcro cloth is used for the fastening means.

DETAILED DESCRIPTION OF THE PREFERRED EMBODIMENT

Figure 1:
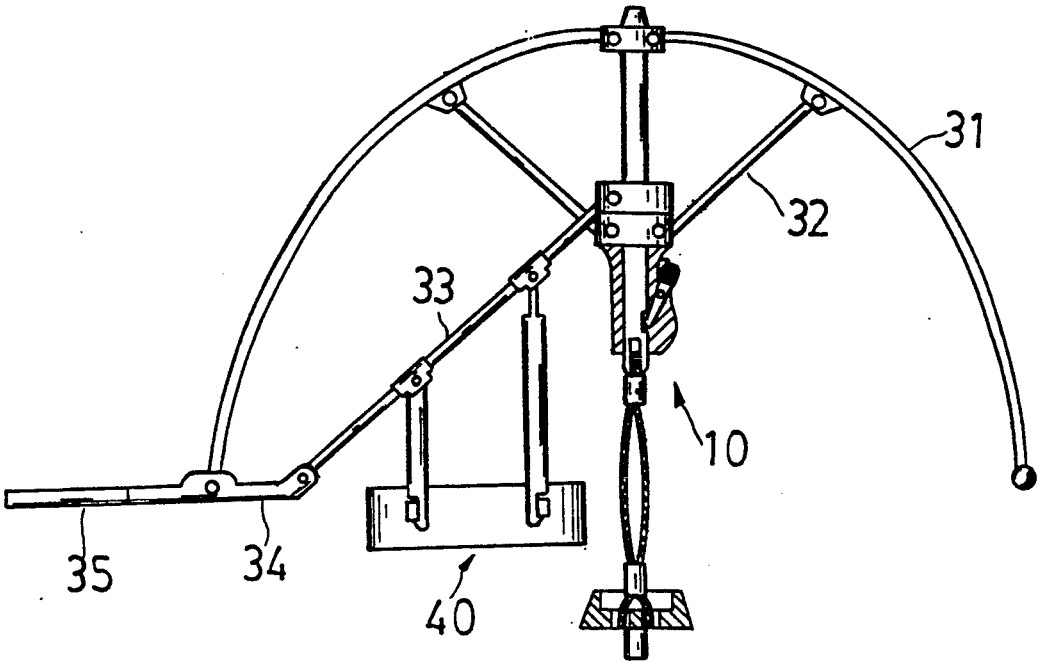
FIG. 1 is a sectional view of the preferred embodiment of the cap-shaped umbrella of the present invention.
Figure 2:
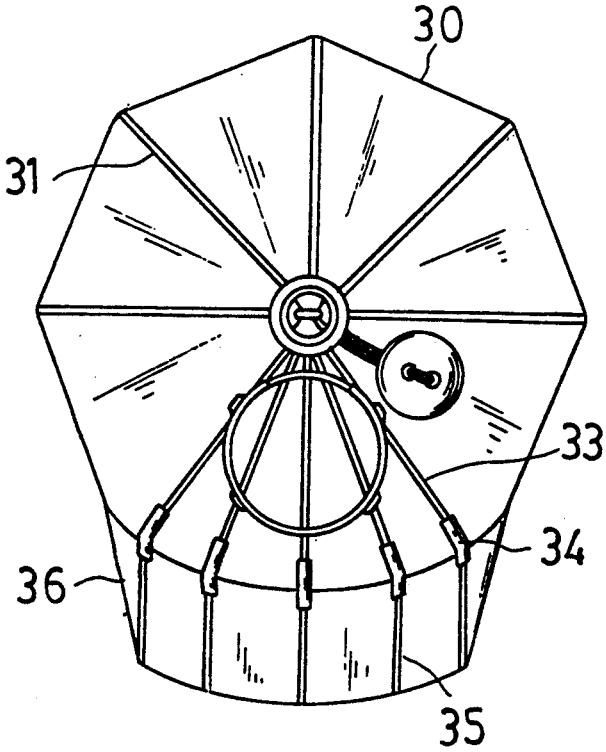
FIG. 2 is a bottom view thereof.

Referring to FIGS. 1 and 2, therein illustrated is a cap-shaped umbrella embodying the present invention which is generally comprised of a folding radial frame, which is consisted of a plurality of main ribs 31 and supporting ribs 32, an umbrella cover 30 stretched over the main ribs 31, a control mechanism 10 pivoted to said folding radial frame, an auxiliary folding frame attached to said folding radial frame at the inside, which auxiliary folding frame is consisted of a plurality of auxiliary ribs 33 having a plurality of horizontal ribs 35 respectively connected thereto by connections 34, which horizontal ribs 35 are pivoted to some main ribs 31 of the folding radial frame to stretch a front visor 36 which extends from the peripheral edge of the umbrella cover 30 at a suitable location, and a fastening loop assembly 40 connected to said auxiliary folding frame for securing the cap-shaped umbrella to an user'head.

Figure 3:
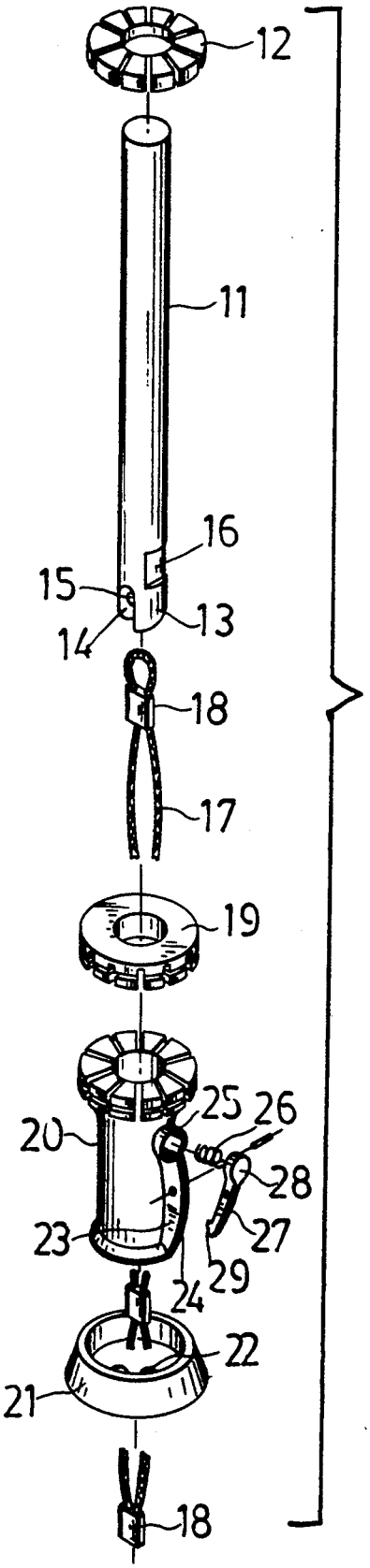
FIG. 3 is an exploded perspective view of the control mechanism thereof.
Figure 4:
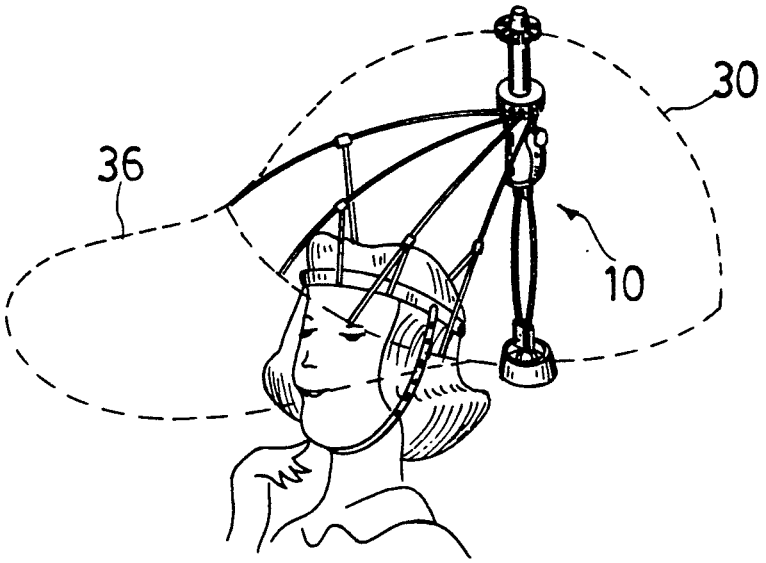
FIG. 4 is a schematic drawing showing that the present invention has been carried on an user's head.

Referring to FIG. 3, the control mechanism 10 comprises a post 11 which has a notch 14 and a pivot hole 15 on the arched bottom edge 13 thereof, a groove 16 on the outer wall surface thereof adjacent to said arched bottom edge 13, an upper nest plate 12 mounted on said post 11 at the top for fastening the ribs 31, and a pull rope 17 hanging on said pivot hole 15 and inserted through a center hole (not indicated) on an auxiliary nest plate, a boring bore (not indicated) on a movable nest plate 20 and two holes 22 on a cap 21 and secured in position by clamps 18 permitting said cap 21 to be retained on said pull rope 17 at the bottom and permitting said auxiliary nest plate 19 and said movable nest plate 20 to be moved up and down on said post 11, wherein said auxiliary nest plate 19 is provided for fastening the auxiliary ribs 33, said movable nest plate 20 is provided for fastening the supporting ribs 32. The movable nest plate 20 is made in a hollow cylindrical shape having a curved side projection 23 projecting from the peripheral surface thereof, which curved side projection 23 defines therein a groove 24 in communication with the center boring bore of the movable nest plate 20 and has a blind hole 25 at one end into which a spring 26 is fastened, and a hook lever 27 pivotably fastened in said groove 24, which hook lever 27 has a unitary knob 28 at one end stopped against the spring 26 and a hooked portion 29 at an opposite end hooked into said groove 24.

Figure 5:
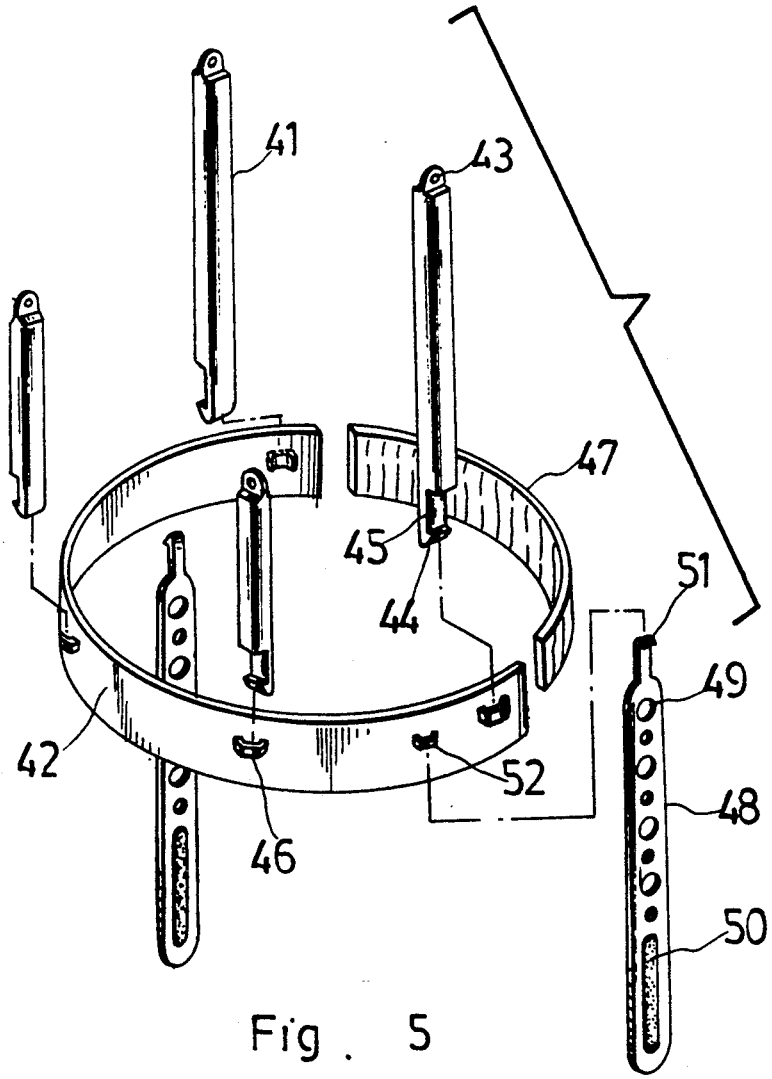
FIG. 5 is an exploded perspective view of the fastening loop assembly thereof.

Referring to FIG. 5, the fastening loop assembly 40 is comprised of a flexible loop 42 for fastening around an user's head, and a plurality of connecting rods 41 for connecting said flexible loop 42 to the auxiliary ribs 33. The flexible loop 42 has a section made from an elastic band 47 so that it can be stretched. Further, the flexible loop 42 has a plurality of lugs 46, 52 projecting from the outer wall surface thereof. The connecting rods 41 are similar in structure but different in length, each of which having a pivot hole 43 at one end connected to either auxiliary rib 33, and a recess 45 and a unitary hook 44 at an opposite end hooked in either lug 46 on the flexible loop 42. There are also provided two fastening bands 48 attached to the flexible loop 42 at two opposite locations, each of which has a unitary hook 51 at one end hooked in either lug 52 on the flexible loop 42, a fastening element 50, which may be a velcro cloth, at an opposite end, and a plurality of vent holes 49 at the middle. By securing the fastening element 50 on one fastening band 48 to the fastening element 50 on the other, the fastening bands 48 can be fastened over an user's lower jaw.

Operation of the present invention is outlined hereinafter. Hold the movable nest plate 20 with one hand and hold the cap 21 with the other hand, and then, pull the cap 21 downwards or move the movable nest plate 20 upwards along the pull rope 17 so as to push the auxiliary nest plate 19 toward the post 11. By means of the guide of the arched bottom end 13, the auxiliary nest plate 19 and the movable nest plate 20 are soon sleeved on the post 11. As soon as the movable nest plate 20 is moved to the groove 16 on the post 11, the hooked portion 29 of the hook lever 27 immediately forced by the spring 26 to hook in the groove 16, and at the same time, the umbrella cover 30 and the front visor 36 are stretched open by by the folding radial frame and the auxiliary folding frame. Once the umbrella is stretched, it can be fastened on an user's head by means of the flexible loop 42 and the fastening bands 48. Because of the arrangement of the fastening bands 48, the umbrella can be tightly comfortably fastened in an user's head against strong wind force. When not in use, the umbrella can be conveniently collapsed. Pressing the knob 28 on the hook lever 27 causes the hooked portion 27 to release from the groove 16, and therefore, stretching force is immediately released from the folding radial frame and the auxiliary folding frame. The movable nest plate 20 is moved to the cap 21 once stretching force is released from the folding radial frame and the auxiliary folding frame, and therefore, the umbrella cover 30 and the front visor 36 are collapsed.

I claim:

1. A cap-shaped umbrella comprising a folding radial frame, said folding radial frame being comprised of a plurality of main ribs supported by a plurality of supporting ribs, an auxiliary folding frame pivoted to said folding radial frame, said auxiliary folding frame comprising a plurality of a plurality of horizontal ribs connected to a plurality of auxiliary ribs, an umbrella cover stretched over said main ribs of said folding radial frame, a front visor connected to the peripheral edge of said umbrella cover and stretched over said horizontal ribs of said auxiliary folding frame, a fastening loop assembly connected to said auxiliary folding frame for fastening the umbrella to the head, and a control mechanism controlled to stretch or collapse said folding radial frame and said auxiliary folding frame, and characterized in that:

said control mechanism comprises a post, an upper nest plate fixedly fastened on said post at the top for fastening said main ribs, a pull rope fastened in said post at the bottom, said pull rope having one end fastened in said post and an opposite end attached with a cap, a tubular auxiliary nest plate mounted on said pull rope for fastening said supporting ribs and moved to slide on said post, a ring-shaped auxiliary nest plate mounted on said pull rope above said tubular movable nest plate for fastening said auxiliary ribs, said tubular movable nest plate comprising a curved side projection defining therein a groove, said curved side projection having a blind hole thereon at the top, said blind hole having a spring fastened therein, a hook lever pivotably fastened in said groove, said hook lever having a knob at one end stopped against said spring and a hooked portion at an opposite end releasably hooked in a groove on said post to retain said folding radial frame and said auxiliary folding frame in a stretched condition;

said fastening loop assembly is comprised of a loop, a plurality of connecting rods for connecting said loop to said auxiliary ribs, and two fastening bands fastened over an user's lower jaw to secure said loop on the user's head, said loop being consisted of a flexible band and an elastic band, said flexible band having a plurality of eyed lugs around the peripheral surface thereof, said connecting rods each having a pivot hole at one end connected to said auxiliary ribs by pins and a unitary hook at an opposite end hooked in either eyed lug, said fastening bands each having a unitary hook at one end hooked in one of said eyed lugs, a fastening element at an opposite end releasably connected to each other for securing the fastening bands over an user's lower jaw, and a plurality of vent holes at the middle.

* * * * *